United States Patent [19]

Byer

[11] Patent Number: 4,883,441

[45] Date of Patent: Nov. 28, 1989

[54] DOLL

[76] Inventor: Andrew Byer, 11839 Doral Ave., Northridge, Calif. 91326

[21] Appl. No.: 256,845

[22] Filed: Oct. 12, 1988

[51] Int. Cl.[4] ..... A63H 3/16; A63H 3/02

[52] U.S. Cl. ..... 446/99; 446/369; 446/901; D21/155

[58] Field of Search ..... 446/99, 100, 369, 371, 446/901; D21/155, 156, 166

[56] References Cited

U.S. PATENT DOCUMENTS

| | | | |
|---|---|---|---|
| D. 49,797 | 10/1916 | Griffith | D21/155 |
| D. 49,916 | 11/1916 | Allison | D21/155 |
| D. 51,490 | 11/1917 | Allison | D21/166 |
| D. 62,294 | 5/1923 | Townsend | D21/155 |
| D. 65,513 | 9/1924 | Allison | D21/155 |
| D. 78,363 | 4/1929 | Pals | D21/166 |
| D. 90,080 | 6/1933 | McMahan | D21/166 |
| D. 90,081 | 6/1933 | McMahan | D21/155 |
| D. 138,399 | 8/1944 | Rice | D21/155 |
| D. 294,724 | 3/1988 | Lund | D21/155 |
| 1,554,712 | 9/1925 | Clark | 446/369 |
| 1,644,317 | 10/1927 | Willey | 446/369 |
| 1,828,765 | 10/1931 | Crist | 446/371 |
| 4,208,832 | 6/1980 | Corriveau | 446/100 |

FOREIGN PATENT DOCUMENTS

| | | | |
|---|---|---|---|
| 0566160 | 9/1975 | Switzerland | 446/99 |
| 2013508 | 8/1979 | United Kingdom | 446/99 |

*Primary Examiner*—Robert A. Hafer
*Assistant Examiner*—Michael Brown
*Attorney, Agent, or Firm*—Lyon & Lyon

[57] ABSTRACT

A doll has a head, arms and legs attached to a body with a hook and loop fastener. The head is configured to resemble a baseball, the arms configured to resemble baseball bats, the legs configured to resemble footballs, with the body resembling a basketball. The head, arms, legs and body each have a soft cloth covering containing a soft filling.

2 Claims, 1 Drawing Sheet

FIG. 1.
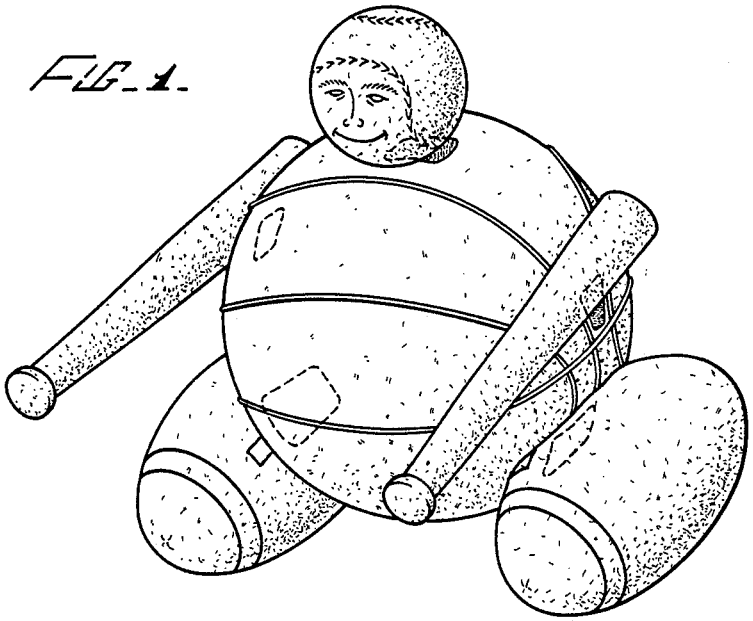
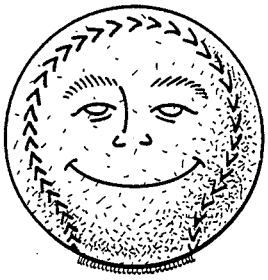
FIG. 2.
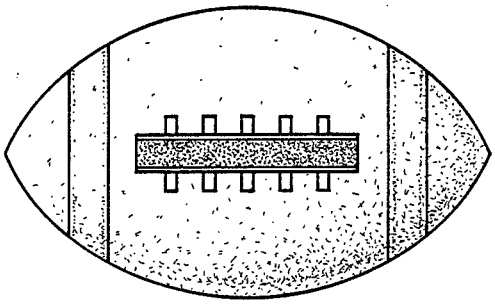
FIG. 3.
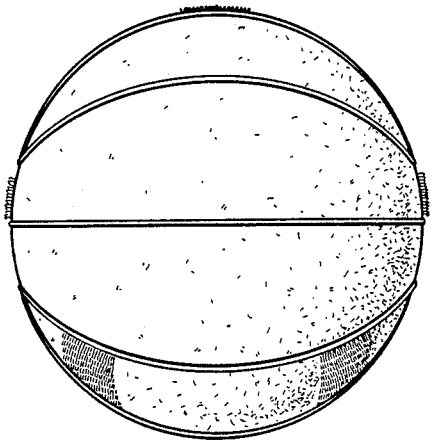
FIG. 4.
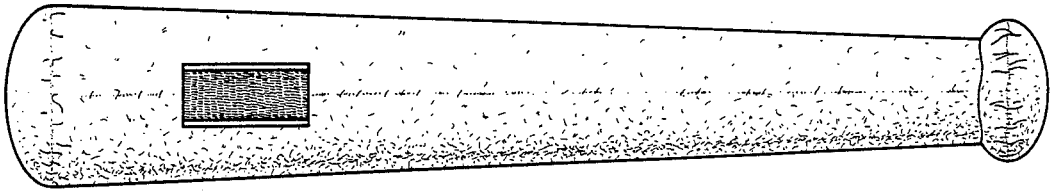
FIG. 5.

DOLL

BACKGROUND OF THE INVENTION

The field of the present invention is dolls. More particularly, the field of the present invention is soft children's dolls.

Various children's dolls have been known in the past. For example, Corriveau, U.S. Pat. No. 4,208,832 discloses a constructable animal doll having various limbs or appendages releasably attachable to a body using Velcro-type attachment strips, to a form a variety of animal figures. In addition, other known dolls have encompassed various elements of the sports equipment, such as baseballs and baseball bats. For example, Allison, U.S. Design Pat. No. D 49,916 illustrates a toy figure having a ball-like head and torso including stitching. McMahan, U.S. Design Pat. Nos. 90,080 and 90,081, and Allison, U.S. Design Pat. No. 46,241 similarly illustrate a doll figure having a ball-like head and body. Moreover, Townsend, U.S. Design Pat. No. 62,294 discloses a toy figure having a football-like torso.

While these known prior art dolls may incorporate one or more sports articles, as far as is known, there has been no doll comprising several sports articles in an attractive arrangement suitable for use by children.

SUMMARY OF THE INVENTION

The present invention is directed to an improved doll. To this end, the instant doll comprises a substantially spherical head and spherical body. A pair of elongate and generally cylindrical arms and a pair of oblong legs are provided. The head, arms, and legs are releasably attachable to the body with, for example, a hook and loop fastener, such as Velcro. The head, arms, legs, and body are made of a soft upholstered construction, including a soft interior filling or stuffing and a soft cloth outer covering or shell.

Preferably, each of the arms is shaped like a baseball bat, and each of the legs is shaped like a football. Most desirably, the head is white, the body is orange, and the legs are brown. The body is ordinarily 2 to 5 times larger in diameter than the head.

In a preferred embodiment, the head is provided with stitched facial features, the body includes embroidered black longitudinal lines or meridians to suggest a basketball, and the legs include football markings and stitching.

Preferably, the legs are releasably attachable to the body generally on opposite sides of the body, with the arms similarly releasably attachable to the body on opposite sides thereof, and spaced apart from the legs, with the head attached to the body at a position in between the arms.

Accordingly, it is an object of the invention to provide a child's doll comprised of several sports articles in an attractive arrangement.

It is the further object of the invention to provide such a doll having body parts which are releasably attachable to each other such that they may be manipulated by a child at play.

Other and further objects and features of the present invention will appear in the following disclosure.

BRIEF DESCRIPTION OF THE DRAWINGS

In the drawings, wherein similar reference characters denote similar elements throughout the several views:

FIG. 1 is a perspective view of the doll of the invention fully assembled;

FIG. 2 is a front view of the head of the doll of FIG. 1;

FIG. 3 is a top view of a leg of the doll of FIG. 1;

FIG. 4 is a front view of the body of the doll of FIG. 1; and

FIG. 5 is a side view of an arm of the doll of FIG. 1.

DETAILED DESCRIPTION OF THE PREFERRED EMBODIMENT

Referring to FIG. 1, the present doll 10 includes a head 12, a body 14, a pair of arms 16, and a pair of legs 18. The head 12, arms 16, and legs 18 are releasably attached to the body 14 with a releasable attachment or fastener, such as, for example, Velcro strips.

As shown in FIG. 2, the head 12 includes embroidered or stitched facial features 22 on one surface thereof. The outside covering 21 is a soft material or cloth which contains a soft stuffing interior, such that the head 12 is of a soft and somewhat compressible construction. A Velcro strip 24 is positioned at the bottom of the head, i.e., below the facial features 22. In the preferred embodiment, the strip 24 may be either a Velcro hook strip or a Velcro loop strip. Stitching 20 is also provided on the head 12 in the form of baseball seams such that the head 12 generally resembles a baseball.

As shown in FIG. 3, each of the legs 18 includes a centrally located Velcro strip 26 as well as football-like embroidery 28. To give the appearance of a football, each leg 18 includes an outer shell or covering 19 made of a soft material or cloth which contains a soft interior filling, in the manner of the head 12. Preferably, the covering 19 is brownish with white embroidery 28, to simulate a football. The embroidery 28 comprises two annular end bands symmetrically spaced apart from the ends of the leg 18, and stitched seams disposed in between the bands.

The body 14, as shown in FIG. 4 is similar in construction to the previously described head 12 and leg 18. The body 14 includes a soft covering 15 containing a soft filling material. Five (5) Velcro strips 30 are positioned on the body 14 at the locations illustrated in FIG. 4 and FIG. 1. Embroidered meridians or longitudinal lines are provided to give the body 14 a basketball-like appearance. In order to further enhance this appearance, the covering 15 can be orange in color with the embroidery 32 being black.

Turning to FIG. 5, each arm 16 includes a soft covering 17 containing a soft filling therein. Adjacent to the larger end 36 of the arm 16 is a Velcro strip 34. At the opposite or smaller end 38 thereof, a knob or end 40 is provided. The arm 16 tapers gradually from the larger end 36 to the smaller end 38. To further create the image of a baseball bat, the covering 17 may be beige in color.

Referring once again to FIG. 1, although the Velcro strips 30 are positioned on the body 14 in order to have the legs 18, arms 16 and head 12 mutually positioned as generally shown in FIG. 1, during use, it is anticipated that any one or more of the head 12, arms 16 and legs 18 may be removed from the body 14 and used or played with separately. In addition, the present doll is intended to facilitate creativity during play by allowing the head 12, arms 16, and legs 18 to be attached to any one of the five (5) Velcro strips 30 on the body 15. Furthermore, the head 12, arms 16 and legs 18 may be reoriented at any of the Velcro strip 30 positions.

While other modifications and embodiments may be apparent to those skilled in the art, it should be appreciated that the invention is susceptible to variation and change without departing from the proper spirit and scope of the accompanying claims.

What is claimed is:

1. A doll comprising:

a spherical head having soft cloth head covering containing a soft filling, said covering including at least an embroidered mouth and eyes and an embroidered baseball-like seam, said covering also having a fastener strip thereon spaced apart from said mouth and opposite said eyes;

a pair of elongate arms, each arm having a soft arm cloth covering containing a soft filling, each arm tapering from a larger end to a smaller end, said smaller end terminating in a knob, each arm having a fastener strip disposed on said covering adjacent said larger end thereof;

a pair of oblong legs, each leg having a soft cloth covering containing a soft filling, said leg covering having a pair of spaced apart annular and embroidered bands and embroidered football-like seams positioned in between said bands, said leg covering further including a fastener strip overlying said football-like seam;

a spherical body having a soft cloth body covering containing a soft filling, said body having a plurality of embroidered basketball-like meridians on said covering thereof, and a plurality of body fastener strips releasably engageable to said fastener strips on said head, arms, and legs, said body fastener strips generally positioned on said body and equally spaced apart over a single meridian circumscribing said body.

2. The doll of claim 1 wherein the body has a radius approximately 2–5 times that of the head.

* * * * *